United States Patent [19]

Zeigler

[11] Patent Number: 4,838,003

[45] Date of Patent: Jun. 13, 1989

[54] HUB ASSEMBLY FOR COLLAPSIBLE STRUCTURES

[76] Inventor: Theodore R. Zeigler, 205 S. Columbus St., Alexandria, Va. 22314

[21] Appl. No.: 941,485

[22] Filed: Dec. 11, 1986

[51] Int. Cl.[4] ..... E04H 12/18

[52] U.S. Cl. ..... 52/646; 403/171; 403/176; 403/174

[58] Field of Search ..... 52/109, 646; 135/109, 135/106, 20 R, 28; 403/171, 172, 176, 174, 178

[56] References Cited

U.S. PATENT DOCUMENTS

| | | | |
|---|---|---|---|
| 1,092,217 | 4/1917 | Hopkins | 403/172 X |
| 3,771,274 | 11/1973 | Vaughan | 52/646 |
| 3,861,107 | 1/1975 | Papayoti | 403/171 X |
| 4,280,521 | 7/1981 | Zeigler | 135/106 X |
| 4,460,288 | 7/1984 | Schaff | 403/171 X |
| 4,473,986 | 10/1984 | Zeigler | 403/171 X |

*Primary Examiner*—Carl D. Friedman

*Attorney, Agent, or Firm*—John P. Snyder

[57] ABSTRACT

A hub structure for a collapsible frame which comprises a pair of similar members having radiating arms. The hub members are in contact with each other such that the arms are in interdigitated relationship. The arms have pivot attachment points for struts and all of the pivot points lie in the same plane.

14 Claims, 2 Drawing Sheets

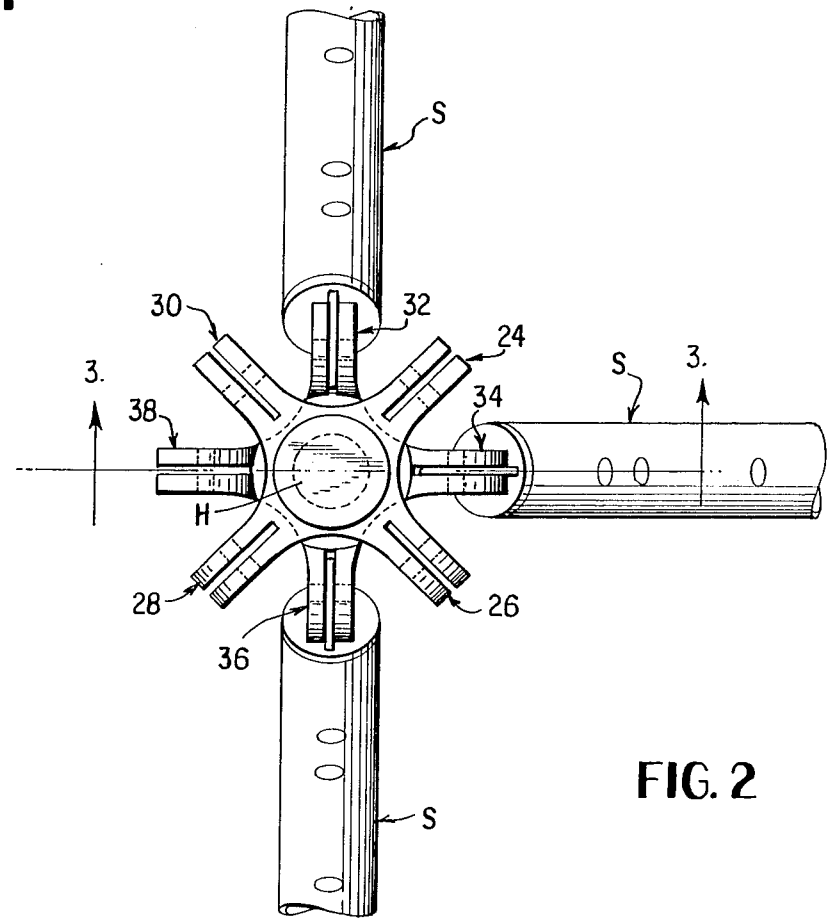
FIG. 2
FIG. 1
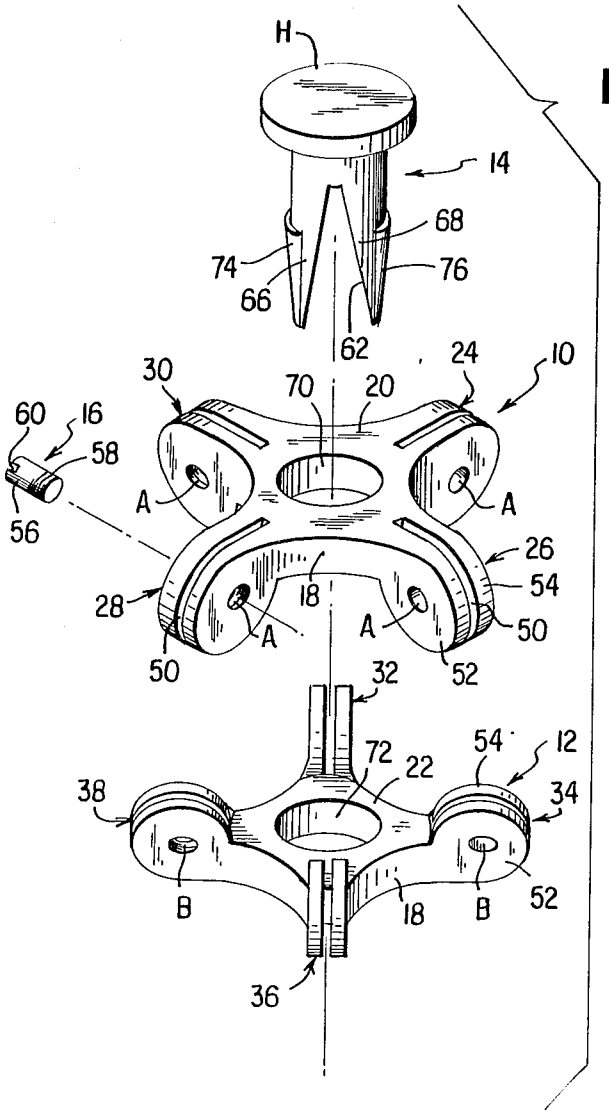

HUB ASSEMBLY FOR COLLAPSIBLE STRUCTURES

BACKGROUND OF THE INVENTION

This invention relates to hub structures for collapsible frames and the like and is related to my prior U.S. Pat. No. 4,280,521 of July 28, 1981, the subject matter of which is incorporated herein by reference. Although I am aware of the references cited in my aforesaid patent, which I do not believe are relevant to the subject matter of this invention, I am also not aware of any other references which are pertinent to this invention or which would be material to the subject matter of this invention.

Hub structures according to my above prior patent have been used extensively in commerce and their features have proven to be fully operative for the intended purposes, imparting rugged hub connectors for various types of collapsible structures including those of the types disclosed in my prior U.S. Pat. No. 3,968,808 of July 13, 1976; 4,026,313 of May 31, 1977; 4,290,244 of Sept. 22, 1981; 4,437,275 of March 20, 1984; 4,473,986 of Oct. 2, 1984; 4,512,097 of Apr. 23, 1985; 4,522,008 of June 11, 1985; 4,561,618 of Dec. 31, 1985; and 4,579,066 of Apr. 1, 1986 and in particular for use in structures which are employed as frames for exhibit displays and as frames used for shelter and other purposes.

The hub of my '051 patent, known as the "ring-and-blade" hub connector requires insertion of the ring through the blades of the struts prior to mating the blade halves and securing them together so as to form a unitary assembly of struts and hub. In contrast, the hub assembly of this invention allows pivotal connection of the struts to the individual halves of the hub structure without requiring the hub halves to be mated and secured together to retain the pivot connections for the struts in place. This allows the hub halves to be mated and secured together as a permanent assembly if desired, or to remain as separate entities releasably joined together as is the case with "split hubs" as disclosed in my aforesaid U.S. Pat. No. 4,473,986.

BRIEF SUMMARY OF THE INVENTION

The invention relates to improvements in hub assemblies for collapsible frames or the like. The hub assembly comprises two hub halves, preferably of identical construction, which are so constructed that when they are mated, they are compelled to register in proper relation and with the pivot connections for all of the struts which are connected thereto lying in substantially the same plane.

The two hub halves are mated in nested relation so that the arms of one hub half interdigitate with the arms of the other hub half and with the respective arms cooperating to effect the proper registry between the halves.

Each hub half is preferably provided with a central face defining a mating surface, so constructed and arranged as to position the radiating arms of the half in such a manner as cooperates with the arms of the other half to achieve the desired registry when the mating surfaces are engaged against each other.

Preferably, the root widths of the arms are dimensioned to equal or substantially equal the root distance between adjacent arms. By "root width" is meant the width of an arm where it radiates from its central face, and by "root distance" is meant the distance between adjacent arms of a hub half where they radiate from the central face. In preferred form, the arms of one half interdigitate with the arms of the other half when the central or contact faces of the two halves of the hub assembly engage in face-to-face contact so that the root distances of one half are filled by the root widths of the other half, thus effecting proper registry between halves.

BRIEF DESCRIPTION OF THE DRAWING FIGURES

FIG. 1 is an exploded perspective view of a hub assembly according to the invention;

FIG. 2 is a plan view of an assembled hub;

DETAILED DESCRIPTION OF THE INVENTION

Figure 5:
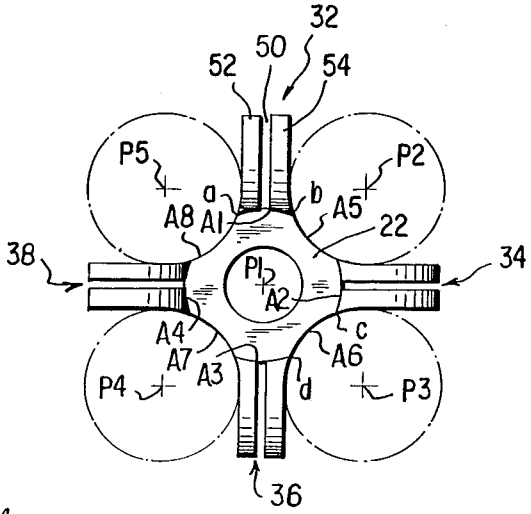
FIG. 5 is a plan view of a hub half illustrating details of its construction.

FIG. 1 illustrates the hub structure in exploded perspective and illustrates the hub half 10 and the cooperating hub half 12 as well as a snap-fitting plug member 14 for releasably securing the halves in engagement and one of the pivot pins 16. Each half comprises a main body portion 18 which, on one side, presents an outer face 20 while, on its other side, is provided with a central face 22. As will be evident, the two central faces of the halves are adapted to engage in mating relation (see FIG. 3) when the member 14 holds them in that position. Each half is provided with a plurality of arms which radiate from their main body portions. Thus, the half 10 is provided with the arms 24, 26, 28 and 30 whereas the other half 12 is provided with the arms 32, 34, 36 and 38.

Figure 3:
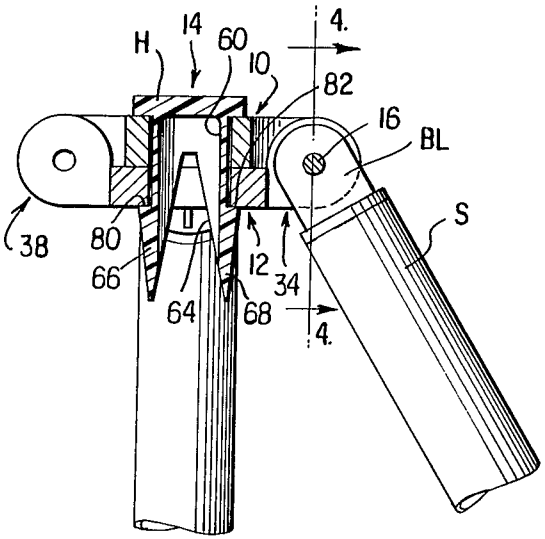
FIG. 3 is a sectional view taken along the plane of section line 3—3 in FIG. 2.

As is seen in FIG. 3, a strut S of the associated collapsible framework with its blade B projecting therefrom and into a slot of the arm 34 is pivotally connected to the arm 34 by means of an associated pivot pin 16. For the sake of clarity, only one strut S is shown in FIG. 3 and only three struts S are illustrated in FIG. 2, it being appreciated that each arm of each half will be provided with an associated strut S.

In FIG. 3, the hub assembly is being employed as a split hub assembly in a framework of the type described in my prior U.S. Pat. No. 4,473,986. For those other hub assemblies of such a framework which are not employed as split hub assemblies, the releasable connector 14 may be dispensed with and the two hub halves secured together in permanent fashion or at least in such a fashion as does not readily permit the releasability afforded by the connectors 14.

At this point, it is well to note that the hub halves may be made from any suitable material such as various metals or from synthetic resinous materials. Preferably, the hub halves are made from aluminum, in which case, those hub assemblies which are not required to separate may be joined by screw thread fastening means or by suitable adhesive techniques at the contacting central faces of the halves. The use of an adhesive technique for joining halves is the method of choice for the ring-and-blade type of hub as in my prior U.S. Pat. No. 4,280,521 wherein the hub members, being made of synthetic resinous material, are most advantageously adhered by applying a solvent for the resinous material at the parting face and clamping the members together for a period of time sufficient to effect an excellent bond which has proven to resist separation between members even under the most severe conditions of use.

FIG. 5 illustrates structural details of a hub half which causes a pair of such halves to orient and register with each other when they are mated. As shown, the four arms 32, 34, 36 and 38 radiate from the main body portion of the hub half at 90° intervals. The central face 22 is flat and is formed as an annulus centered at the point P1 and having a radius which is the same as or substantially the same as the radii of the broken line circles centered at the points P2, P3, P4 and P5. The points P2–P5 are located on orthogonally directed radii projected from the point Pl and at such distances from the point Pl as to assure that the arcs Al, A2, A3 and A4 are substantially equal in length and that the intervening concave arcs A5, A6, A7, and A8 are also substantially equal in length and to the length of the other arcs A1–A4. In this way, the root width of each arm, defined by the distance between the points a and b, will be the same or substantially the same as the root distance between adjacent arms, i.e., defined by the distance between points c and d. When the points P1–P5 are related as shown and described, the arms of the two hub halves will substantially precisely interdigitate when the halves are mated to position not only the arms but also the main body portions in a particularly oriented and registered relation, the root widths of one hub half filling the root distances of the other hub half and the two central faces being in face-to-face contact.

The arms of each hub half are substantially twice as thick as the main body portion from which they radiate so that, when the hub halves are mated, the pivot pin apertures in the two sets of arms may be located to lie substantially in the same plane when the halves are mated. Thus, the apertures A (see FIG. 1) in the set of arms associated with the hub half 10 will be at the same level as the aperture B of the set of arms associated with the other hub half 12 when the halves are mated as aforesaid. This preserves a very desirable feature of the ring-and-blade hub assembly in that the pivot axes for all of the strut ends connected to a hub are in the same plane. This is particularly useful in a split hub assembly because it avoids the "weaving" of struts which otherwise occurs in a framework which employs this type of hub where two ring-and-blade hubs are stacked one upon the other to form the split hub assembly. In order to preserve symmetry of the two hub halves and to assure that they are interchangable, the apertures A and B are centered at points which lie substantially in the planes of their associated central face 22, as is best seen in FIG. 3.

Figure 4:
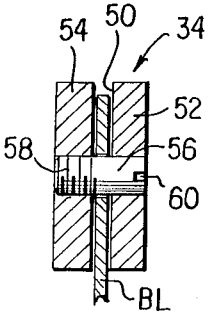
FIG. 4 is a sectional view taken along the plane of section line 4—4 in FIG. 3.

Each arm of each hub half is provided with a radially extending slot 50 defined between the bifurcations 52 and 54 of each arm. Each slot 50 preferably extends from the base circle of the central face of its hub half, i.e., from the associated arc A1–A4 and the bifurcations 52 and 54 are rounded off in those portions which extend away from the plane of the central face 22, i.e., in those portions which interdigitate in circumferentially spaced relation when the hub halves are mated to provide the circularly registering sets of bores B. The bores B may both be internally threaded if production considerations require it for economy or only one of them in each pair of bores may be internally threaded. In any case, each pin 16 is provided with a shank portion 56 having the same external diameter as the threaded portion 58 thereof so that the shank portion 56 fits snugly in one bore B of its associated arm while the threaded portion 58 is threadedly received in the internally threaded bore of the pair of bores B, irrespective of whether one or both bores of the pair is internally threaded. Each pin is also provided with a screw driver slot 60 and each preferably is of a length to be flush with the outer surfaces of the bifurcations 52 and 54 as is illustrated in FIG. 4. The aperture in each blade BLB or strut end is dimensioned pivotally to receive the shank portion of its associated pin 16 with little clearance, as is also shown in FIG. 4.

Each hub half lends itself well to formation by standard production techniques. For example, if the hub halves are made of aluminum, they may easily be made by die casting to the precise dimensions and relations as in FIG. 5 and the only machining required of such parts is a normal deburring operation and internal threading of one or both bores B of each pair thereof.

Each connector 14 is provided with a head portion H and a blind internal bore 60 and diametrically opposed tapered notches 62 and 64. The bifurcations thus formed allow the nose portions 66 and 68 to deform toward each other as a pin 14 is inserted through the central openings 70 and 72 of the hub halves. The bifurcations or more portions 66 and 68 are formed with wedge-shaped cam portions 74 and 76 which define the stop shoulders 80 and 82 which snap behind the outer surface of the inner hub half when the two hub halves are mated as illustrated in FIG. 3. Thus, the length of each pin from the inner side of its head to the shoulders 80 and 82 is substantially equal to twice the thickness of a main body portion of a hub half to assure good face-to-face contact of the central faces of the two hub halves. As noted before, the interdigitation of the two halves when mated assure proper orientation and registry therebetween, the two central openings 70 and 72 being substantially precisely aligned and registered in the process. If the hub halves are to be removably related as in a split hub pair, the connector 14 is retained with the outer hub half when the hub halves are separated by squeezing the ends of the connector bifurcations together to allow separation and entry of the cam portions 66 and 68 into the central opening 72 of the inner hub half 12 as the halves are separated, ultimately allowing the bifurcations to spring back to their normal positions in which the stop shoulders 80 and 82 will now prevent withdrawal of the connector from the outer hub half 10 so that the connector is carried by this outer hub half.

What is claimed is:

1. A hub assembly for collapsible frames which comprises the combination of a pair of similar rigid hub members having radiating arms, said arms being rigidly secured to said hub members in fixed relationship thereto, the hub members being disposed in contact such that the arms thereof are in interdigitated relation, and a strut pivotally attached to each arm member wherein the pivot axes of the struts to the arms are substantially in the same plane.

2. A hub assembly as defined in claim 1 including pivot means for freely pivotally attaching each blade to one of the arms to allow each strut to seek and attain its own angular relation to its arm.

3. A hub assembly for collapsible frames comprising first and second hub members, means for maintaining the hub members in juxtaposition, a first set of arms radiating from the first hub member and a second set of arms radiating from the second hub member, the arms of the first set of arm members being provided with apertures and the arms of the second set of arm members being provided with apertures, the apertures of the first set of arms being disposed in substantially the same plane and the apertures of the second set of arms being disposed in substantially the same plane, and the arms of the first hub member being interdigitated with the arms of the second hub member such that the apertures of the two arms are disposed in substantially the same plane.

4. A hub assembly for collapsible frames, comprising the combination of a pair of hub members each having a main body portion and each main body portion having a central face, a set of arms radiating from each main body portion with respect to a corresponding central face so that each set of arms define gaps therebetween beyond the associated central face, the gaps defined by one set of arms receiving the other set of arms when the central faces of the two main body portions are in contact, each arm having an inwardly extending slot for receiving an apertured end of a strut and each arm having a bore therethrough extending transversely of an associated slot, pivot means extending through each bore and through an aperture of a corresponding strut, the arms of the two set thereof being interdigitated sufficiently to locate the pivot means substantially in the same plane when the central faces are in mating contact, and means for holding the central faces in contact.

5. In a collapsible frame including a plurality of struts movable between a bundled condition and an expanded condition, and hub means interconnecting the struts for permitting the movement between the collapsed and expanded conditions, the hub means comprising first and second hub members each provided with radiating arms to which the struts are pivotally connected, the arms being constructed and arranged to interdigitate the arms of the first hub member with the arms of the second hub member so as to position all of the pivots defined by such arms substantially in the same plane.

6. A hub assembly for collapsible frames which comprises a pair of similar hub halves each having a central body portion of a given thickness and each main body portion defining a flat inner face and a flat outer face, a plurality of arms radiating from each main body portion at uniformly spaced positions, each arm having a root portion joined with its associated main body portion having a width substantially equal to the spacing between adjacent arms and projecting therefrom in a widened portion projecting away from the plane of the inner face of its associated main body portion, each widened portion having a pivot pin aperture centered at a point lying substantially in the plane of the associated inner face, and connector means for retaining the inner faces of the two hub halves in face-to-face engagement so that all of the apertures lie substantially in the same plane.

7. A hub assembly as defined in claim 6 wherein the connector means comprises a bifurcated member snap fitted through the hub halves.

8. A hub assembly as defined in claim 6 wherein the connector means comprises an adhesive connection between the hub halves.

9. In a collapsible/expandable structure, the combination of a hub assembly and a plurality of elongate struts pivotally attached, each at one end thereof, to the hub assembly along a portion of a closed path in encompassing relation to the hub assembly, the hub assembly comprising first and second rigid halves each having arms radiating therefrom, said arms being rigidly secured to the respective halves in fixed relationship thereto, the arms of the first half interdigitating with the arms of the second half, and pivot means pivotally attaching the struts to the interdigitating arms along the path, whereby the one ends of the struts are clustered around the hub assembly and define as acute, solid angle when the structure is in its expanded condition.

10. In a structure as defined in claim 9 wherein the pivot means define pivot axes lying in the path and in substantially uniformly spaced relation to each other.

11. In a collapsible/expandable structure, the combination of a hub assembly, a plurality of elongate struts radiating from the hub assembly and movable relative thereto between collapsed condition and an expanded condition wherein the struts radiate in uniformly spaced relation around and angularly from the hub assembly to define a cone truncated at the hub assembly, and pivot means for pivotally connecting each strut at an end thereof to the hub assembly, the hub assembly comprising first and second rigid portions, said first portion having first spaced arms projecting therefrom, said first arms being rigidly secured to said first portion in fixed relationship thereto, said second portion having second spaced arms projecting therefrom, said second arms being rigidly secured to said second portion in fixed relationship thereto, the arms of the two portions being in interdigitated relation to pass from opposite sides of the hub assembly through a common plane and receiving pivot means to define pivot axes for the struts which lie in circumferentially encompassing relation to the hub assembly.

12. In a structure as defined in claim 11 wherein the pivot axes lie substantially in the common plane.

13. A hub assembly for collapsible frames which comprises the combination of a pair of similar hub members having radiating arms, the hub members being disposed in contact such that the arms thereof are in interdigitated relation, a strut pivotally attached to each arm member wherein the pivot axes of the struts to the arms are substantially in the same plane, each of the arms being provided with an opening and each strut being pivotally attached to an arm at an opening thereof to define a pivot axis between the arm and the strut and passing through the opening.

14. A hub assembly as defined in claim 13 including pivot means received in the openings for freely pivoting the struts to the arms at the pivot axes.

* * * * *